US012540465B2

(12) United States Patent
Nowicki et al.

(10) Patent No.: US 12,540,465 B2
(45) Date of Patent: Feb. 3, 2026

(54) TELESCOPIC SNAP-FIT SUMP BASIN, AND THE LIKE

(71) Applicants: Craig Nowicki, South Bend, IN (US); Corey Christian Parsons, Edwardsburg, MI (US)

(72) Inventors: Craig Nowicki, South Bend, IN (US); Corey Christian Parsons, Edwardsburg, MI (US)

(73) Assignee: Jackel, Inc., Mishawaka, IN (US)

( * ) Notice: Subject to any disclaimer, the term of this patent is extended or adjusted under 35 U.S.C. 154(b) by 0 days.

(21) Appl. No.: 17/803,840

(22) Filed: Dec. 8, 2022

(65) Prior Publication Data

US 2024/0191490 A1 Jun. 13, 2024

(51) Int. Cl.
*E03F 5/04* (2006.01)

(52) U.S. Cl.
CPC ..... *E03F 5/04* (2013.01)

(58) Field of Classification Search
CPC ..... E03F 5/04
USPC ..... 220/4.01, 6, 8
See application file for complete search history.

(56) References Cited

U.S. PATENT DOCUMENTS 4,973,189 A * 11/1990 Bechtold ..... E01F 15/003 220/8
6,059,208 A * 5/2000 Struthers ..... E03F 5/26 241/46.01
6,385,913 B1 * 5/2002 Ahn ..... E02D 29/12 404/26
8,096,439 B2 * 1/2012 Fogerlie ..... H01M 50/251 220/567.1
2007/0039095 A1 * 2/2007 Lawson ..... E04H 4/1272 4/507
2014/0271126 A1 * 9/2014 Gray ..... F04B 23/021 415/88
2015/0253055 A1 * 9/2015 Tsui ..... B62B 1/12 280/655
2023/0278783 A1 * 9/2023 Hallman ..... B65F 1/1447 220/484

FOREIGN PATENT DOCUMENTS

KR 20180039852 A * 4/2018

* cited by examiner

*Primary Examiner* — Orlando E Aviles
*Assistant Examiner* — Niki M Eloshway
(74) *Attorney, Agent, or Firm* — Gardner, Linn, Burkhart & Ondersma LLP

(57) ABSTRACT

A sump basin is provided which is formed from telescopically interfit portions which can be snap-fit into an expanded position of increased vertical height by use of one or more ledges formed on circumferential ribs, merely by pulling up on the top segment once the collapsed basin is in place and a sump pump is mounted therein.

5 Claims, 3 Drawing Sheets

TELESCOPIC SNAP-FIT SUMP BASIN, AND THE LIKE

BACKGROUND OF THE INVENTION

The present invention relates generally to sump pumps and sump basins, and, more particularly, to installation of sump basins in pre-existing structures, such as residential housing.

In order to ensure better water drainage in homes, for example, sump basins have been used to gather water which would otherwise intrude upon the home interior. Pumps are typically placed in those basins to remove the water which gathers in the sump basins. However, sump basins are typically installed to extend three or more feet below the ground level of the home. Accordingly, when installing sump basins into pre-existing homes, there are often difficulties in negotiating the low crawl spaces under the homes, typically having only 15 inches of clearance, for example. A conventional one piece basin simply cannot fit into such crawl spaces, much less be easily placed into a three or more foot deep hole dug within the crawl space.

It has been suggested to use multi-segment sump basins in those circumstances, which can be threaded together once the sump hole has been dug. However, threading those sections together can be tedious and complicated due to the debris and dirt adjacent the segment threading and the logistics of maneuvering the segments within a crawl space. Similarly, other means of joining the segments together have not been satisfactory as well, given the close confines of the crawl space and the depth of the hold needed for the basin to fit into.

OBJECTIVES OF THE INVENTION

Accordingly, a primary objective of the present invention is to provide improved sump basin for use in confined spaces. These improvements include providing sump basins which:

a. have a less overall cost of manufacture, installation, and maintenance,
b. increase the economy of use and/or operation,
c. comply with applicable governmental regulations, and
d. accommodate a wide variety of different uses.

SUMMARY OF THE INVENTION

These and other objectives of the present invention are achieved by the provision of a sump basin formed from telescopically interfit portions which can be snap-fit into an expanded position of increased vertical height by use of one or more ledges formed on circumferential ribs, merely by pulling up on the top segment once the collapsed basin is in place and a sump pump is mounted therein.

Other objects, advantages, and novel features of the present invention will become readily apparent from the following drawings and detailed description of certain preferred and alternative embodiments.

DETAILED DESCRIPTION OF PREFERRED EMBODIMENTS

Figure 1:
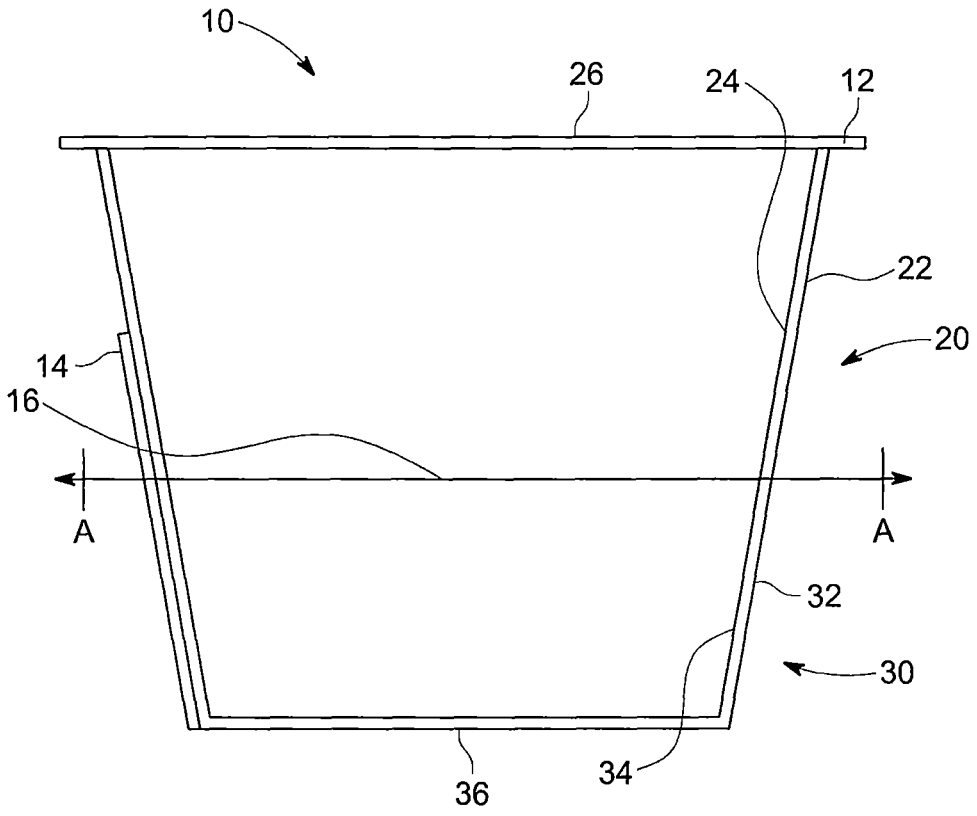
FIG. 1 shows a cross-sectional view of a conventional sump basin which can be modified to form the present invention.

The figures show schematically, and in best mode versions, embodiments of the present invention, both generically and specifically. The drawings are not precisely to scale from one to the next.

The following numbered features are illustrated in the drawings:

Sump basin 10, having:
- a top lip 12,
- at least one reinforcing rib 14 extending vertically,
- upper portion 20, with
  - outer surface 22,
  - inner surface 24,
  - top edge 26, which forms a opening into sump basin 10,
- lower portion 30,
  - outer surface 32,
  - inner surface 34,
  - bottom 36, and
- perforations 44 spaced conventionally about the sump basin which permit water to enter the basin and be collected thereby for removal by a conventional sump pump (not shown) which rests upon bottom 36.

To create the present invention, preferred embodiments have cut a conventional sump basin along line 16 to form upper portion 20 and lower portion 30. That cut creates a bottom edge in upper portion 20 along line 16, and creates a top edge in lower portion 30 along line 16. Further the portion of rib 14 on lower portion 30 which is adjacent to the top edge of lower portion 20 is removed, such as by grinding or a lathe, to create a flat portion 40 having a projecting ledge 42.

Figure 2:
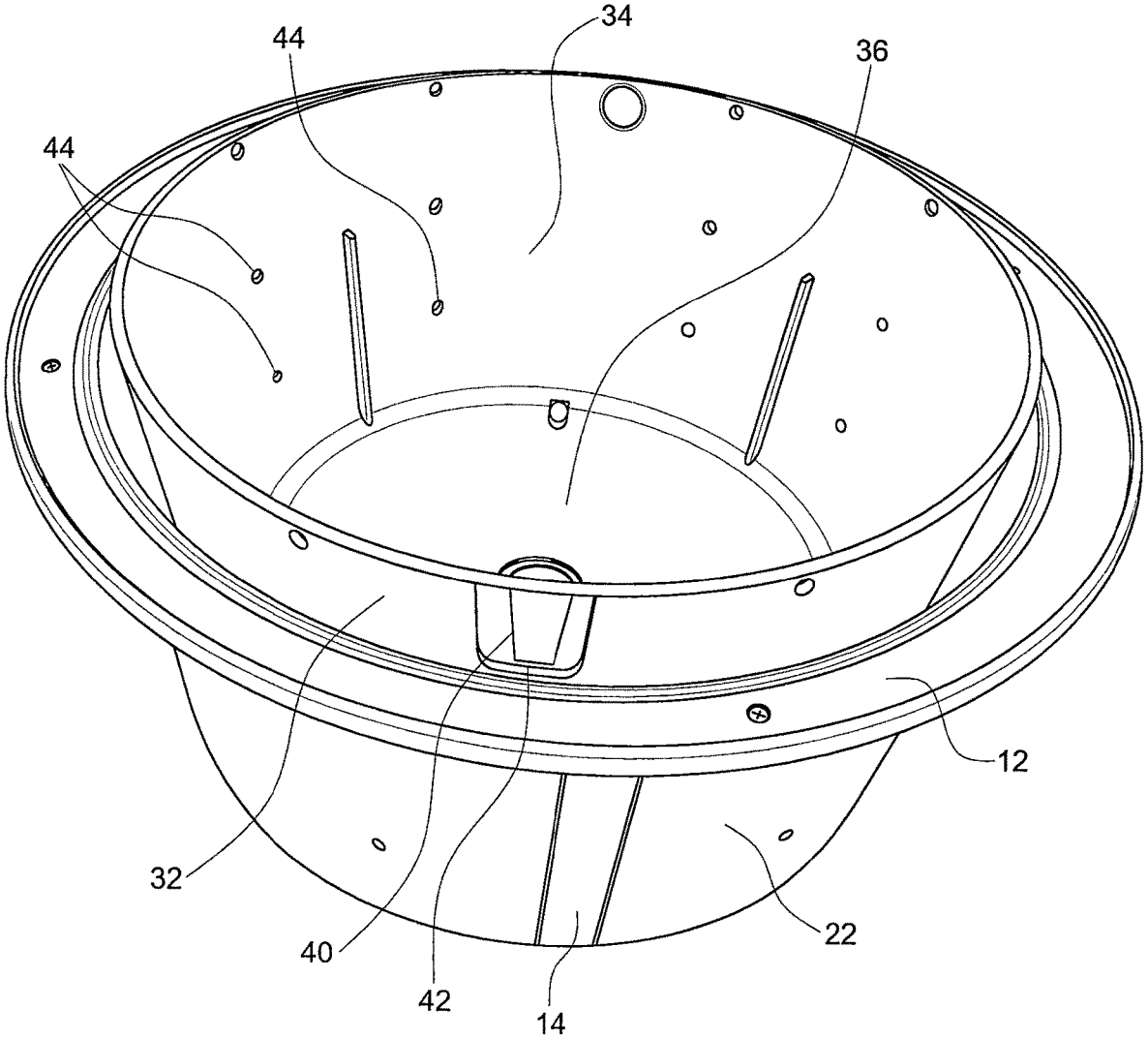
FIG. 2 shows an upper, right perspective view of a sump basin according to the present invention when in a collapsed position.
Figure 3:
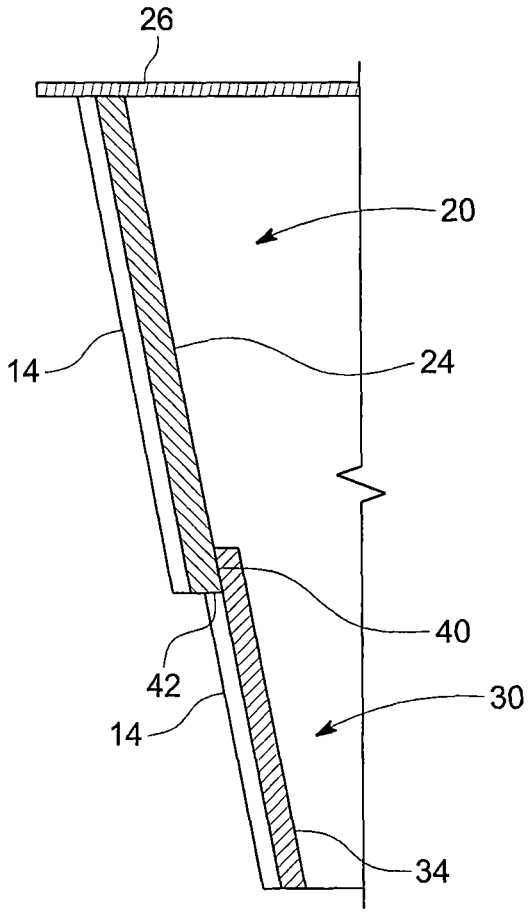
FIG. 3 shows a partial cross-sectional view of a sump basin according to the present invention when in an expanded position.

Briefly, these elements interact as follows:

Lower portion 30 is placed within upper portion 20, as shown in FIG. 1, such that they are in a telescopic relation. FIG. 2 shows the sump basin of the present invention in a collapsed position having its smallest vertical height. Top lip 12 allows upper portion to be readily lifted, such that inner surface 24 slides over outer surface 32 and rib 14 on lower portion 30, until the bottom edge of upper portion 20 reaches flat portion 40 above ledge 42. Preferably, at least the region of upper portion 20 adjacent its bottom edge is formed from flexible or resilient material which allows the circumference of that bottom edge to expand as it passes over the widest portion of the circumference of lower portion 30 and then contract (with a "snap") to a smaller circumference as it rests on ledge 42. Preferably, however, the circumference of the bottom edge of upper portion 20 does not allow upper portion 20 to be completely removed from lower portion 30. Thus, upon being raised to flat portion 40, upper portion 20 is locked into that expanded position, where the vertical height of the sump basin is significantly higher than at its collapsed position.

Although the present invention has been shown and described herein with respect to certain preferred embodiments and alternative configurations, those were by way of illustration and example only. For example, in especially preferred embodiments, the weight and location of the sump pump will facilitate locking of upper portion 20 into place as it is raised. Also, in other embodiments, upper portion 20 can be twisted onto flat portion 40 without need for use of flexible material in upper portion 20. Accordingly, the spirit and scope of the present invention is intended to be limited only by the terms of the appended claims.

What is claimed is:

1. A sump basin comprising:

a lower portion, and an upper portion, those portions being disposed with respect to each other such that those portions are movable with respect to each other between a collapsed position and an expanded position, wherein in the collapsed position the lower portion is disposed within the upper portion at least in part and the sump basin has a first vertical height, and wherein in the expanded position the upper portion projects further above the lower portion than it does in the collapsed position and the sump basin has a second vertical height which is greater than the first vertical height, wherein the upper portion is telescopically movable with respect to the lower portion, wherein the upper portion is locked against movement with respect to the lower portion when the upper portion is telescopically extended with respect to the lower portion such that the sump basin has reached the second vertical height, the lower portion has an inner surface and an outer surface and includes at least one vertically extending rib on its outer surface, and the upper portion has an inner surface and an outer surface and during at least a portion of the telescopic movement the inner surface of the upper portion engages the vertically extending rib.

2. The sump basin according to claim 1 wherein:

the lower portion has a bottom and a top edge with a vertical distance between the bottom and the top edge, the vertically extending rib terminates below the top edge and forms a ledge which projects from the outer surface of the lower portion, the upper portion has a bottom edge and a top edge with a vertical distance between that bottom edge and that top edge, and when the upper portion is locked against movement with respect to the lower portion, the bottom edge of the upper portion abuts the ledge.

3. The sump basin according to claim 2 wherein:

the lower portion is tapered such that the circumference of its outer surface is smaller adjacent to the bottom than adjacent to its top edge, and the upper portion is tapered such that the circumference of its outer surface is smaller adjacent to its bottom edge than adjacent to its top edge.

4. The sump basin according to claim 3 wherein the upper portion is formed from flexible material adjacent its bottom edge, sufficiently flexible to allow its bottom edge to slide over the vertically extending rib and thereby enlarge the circumference of its inner surface as the upper and lower portions are moved respectively toward the expanded position and then contract to a smaller inner surface circumference as the bottom edge of the upper portion moves above the vertically extending rib.

5. The sump basin according to claim 2 wherein the upper and lower portions are formed from a unitary, vertically tapered sump basin which is cut into separate sections along a vertical dimension of the sump basin.

* * * * *